US007862361B2

(12) United States Patent
Wahlberg

(10) Patent No.: US 7,862,361 B2
(45) Date of Patent: Jan. 4, 2011

(54) ELECTRICAL FLEX CONNECTOR FOR MOUNTING ON A PRINTED CIRCUIT BOARD

(75) Inventor: Karl Per Magnus Wahlberg, Stockholm (SE)

(73) Assignee: Sony Ericsson Mobile Communciations AB, Lund (SE)

( * ) Notice: Subject to any disclaimer, the term of this patent is extended or adjusted under 35 U.S.C. 154(b) by 0 days.

(21) Appl. No.: 12/700,804

(22) Filed: Feb. 5, 2010

(65) Prior Publication Data

US 2010/0136815 A1 Jun. 3, 2010

Related U.S. Application Data

(63) Continuation of application No. 12/253,574, filed on Oct. 17, 2008, now Pat. No. 7,713,080.

(51) Int. Cl.
*H01R 12/24* (2006.01)

(52) U.S. Cl. ..... 439/329; 439/493

(58) Field of Classification Search ..... 439/329, 439/343, 260, 495, 493
See application file for complete search history.

(56) References Cited

U.S. PATENT DOCUMENTS 3,673,152 A 6/1972 Minagawa et al.
4,583,800 A 4/1986 Roberts et al.
6,960,094 B2 11/2005 Tomonari et al.
7,029,320 B2 4/2006 Maejima
2004/0018767 A1 1/2004 Buck et al.
2004/0033717 A1 2/2004 Peng
2004/0203274 A1 10/2004 Peng
2005/0020115 A1 1/2005 Edwardsen et al.
2006/0240697 A1 10/2006 Cronch et al.
2007/0037440 A1 2/2007 Uchida et al.
2007/0197104 A1 8/2007 Nagawatari
2010/0099291 A1* 4/2010 Lee ..... 439/329

FOREIGN PATENT DOCUMENTS

EP 1 414 282 A2 4/2004

OTHER PUBLICATIONS

International Search Report and Written Opinion for corresponding Application No. PCT/EP2009/054126 dated Jun. 24, 2009.

* cited by examiner

*Primary Examiner*—Gary F. Paumen
(74) *Attorney, Agent, or Firm*—Renner, Otto, Boisselle & Sklar, LLP

(57) ABSTRACT

An electrical flex connector device for a printed circuit board, comprising a female member having a fixation portion for affixing the female member to an associated printed circuit board, a tab member extending from the fixation portion and configured to guide a male member of the flex connector device and to hold the male member between the tab member and the printed circuit board and a least one fastening member arranged on the female member for securely holding the male member in a predetermined position.

6 Claims, 6 Drawing Sheets

ELECTRICAL FLEX CONNECTOR FOR MOUNTING ON A PRINTED CIRCUIT BOARD

CROSS-REFERENCE TO RELATED APPLICATION

This Nonprovisional application is a continuation of U.S. patent application Ser. No. 12/253,574 filed Oct. 17, 2008, the entire contents of which are hereby incorporated by reference.

TECHNICAL FIELD

The present invention relates in general to electrical connectors for use on printed circuit boards and, more particularly, to an electrical flex connector configured to be mounted on or otherwise secured to a printed circuit board.

BACKGROUND ART

Many electronic devices such as mobile phones, computers, media player and so forth include printed circuit boards. Printed circuit boards also may be referred to as printed wire boards. The printed circuit boards may retain one or more circuit components and may establish connectivity to contacts of the circuit components. For instance, the printed circuit board may include conductive electrical signal pathways to connect the circuit components to power, ground and/or other signals. In addition, the printed circuit board may include conductive electrical pathways to connect the circuit component to another component that is mounted on the printed circuit board or another component that is located remotely off of the printed circuit board so that signals may be exchanged between the circuit component and these other components.

Flex connectors are generally used to connect printed circuit boards to other printed circuit boards. Conventional flex connectors consume a substantial amount of space inside the electronic device, which generally requires electronic devices to be bulkier than otherwise desired.

SUMMARY OF THE INVENTION

With the above description in mind, then, an aspect of some embodiments of the present invention is to provide an electronic flex connector, which seeks to mitigate, alleviate or eliminate one or more of the above-identified deficiencies in the art and disadvantages singly or in any combination.

An aspect of the present invention relates to a flex connector adapted for being connected to a printed circuit board, comprising at least one means for guiding the flex connector into a predetermined position for being connected to the printed circuit board and at least one contact member. The flex connector is configured to push the at least one contact member onto electrical contact with associated at least one contact portion on the printed circuit board.

In one embodiment is the at least one means for guiding a protruding member, positioned on at least one side of the flex connector. Further the protruding member, positioned on at least one side of said flex connector, may comprise at least one of following: a hole, a notch, a bump, a hook, a male or a female snap locking member.

In one embodiment, the protruding member may comprise at least one fixation member.

In one embodiment, the at least one means for guiding may comprise at least one of following: a protruding part, a hole, a notch, a bump, a hook, a male or a female snap locking member.

In one embodiment, the flex connector may be configured for having a spring characteristics for pushing the flex connector and the at least one contact members onto electrical contact with associated at least one contact portion on the printed circuit board.

In one embodiment, the flex connector may comprise a stiffener, wherein the stiffener having a spring characteristics for pushing the flex connector and the at least one contact members onto electrical contact with associated at least one contact portion on the printed circuit board. The at least one means for guiding may be a protruding member positioned on at least one side of the stiffener.

Another aspect of the present invention relates to an electrical flex connector device for a printed circuit board, comprising a female member having a fixation portion for affixing the female member to an associated printed circuit board and a tab member extending from said fixation portion. The tab member may be configured to guide a male member of the flex connector device and to hold the male member between the tab member and the printed circuit. Further the flex connector device may comprise a least one fastening member arranged on the female member for securely holding the male member in a predetermined position. The male member may comprise at least one means for guiding the male member into the predetermined position for being connected to the printed circuit board and at least one contact member, wherein the male member may be configured to push the at least one contact member onto electrical contact with associated at least one contact portion on the printed circuit board.

In one embodiment, the at least one means for guiding is a protruding member, positioned on at least one side of the male member. The protruding member may comprise at least one fixation member. Further on the protruding member may comprise at least one of following: a hole, a notch, a bump, a hook, a male or a female snap locking member.

In one embodiment, the at least one means for guiding may comprise at least one of following: a protruding part, a hole, a notch, a bump, a hook, a male or a female snap locking member.

In one embodiment, the male member may be configured for having a spring characteristics for pushing the male member and the at least one contact members onto electrical contact with associated at least one contact portion on the printed circuit board.

In one embodiment, the male member may comprise a stiffener, wherein the stiffener having a spring characteristics for pushing the male member and the at least one contact members onto electrical contact with associated at least one contact portion on the printed circuit board. Further, the at least one means for guiding may be a protruding member positioned on at least one side of the stiffener.

In one embodiment, the protruding member may comprise at least one fixation member.

In one embodiment, the protruding member may comprise at least one of following: a hole, a notch, a bump, a hook, a male or a female snap locking member.

In one embodiment, the female member may comprise a first and second sides extend from the fixation portion.

The features of the above-mentioned embodiments can be combined in any combinations.

Some embodiments of the invention provide a male and a female flex connector. It is an advantage with some embodiments of the invention that they may allow for reducing the size and cost of electronic devices utilizing multiple printed circuit boards. Further advantages with some embodiments of the invention are that they provide for improved electrical shielding and less electrical resistance.

BRIEF DESCRIPTION OF THE DRAWINGS

Further objects, features and advantages of the present invention will appear from the following detailed description of the invention, wherein embodiments of the invention will be described in more detail with reference to the accompanying drawings, in which.

DETAILED DESCRIPTION

Embodiments of the present invention relate, in general, to the field of electronic connectors for printed circuit boards for use in a mobile phone. However, it should be appreciated that the invention is not intended to be limited to the context of a mobile phone and may relate to an electrical connector for a printed circuit board used in any type of electronic equipment. Non-limiting examples of other types of electronic equipment include a media player, a gaming device, a computer, a video monitor, an appliance, and a global positioning system. Also, the interchangeable terms "electronic equipment" and "electronic device" include portable radio communication equipment. The term "portable radio communication equipment," which herein after is referred to as a "mobile phone," includes all equipment such as mobile radio terminal, pagers, communicators, electronic organizers, personal digital assistants (PDAs), smartphones, portable communication apparatus or the like.

Embodiments of the present invention will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference signs refer to like elements throughout.

Figure 1:
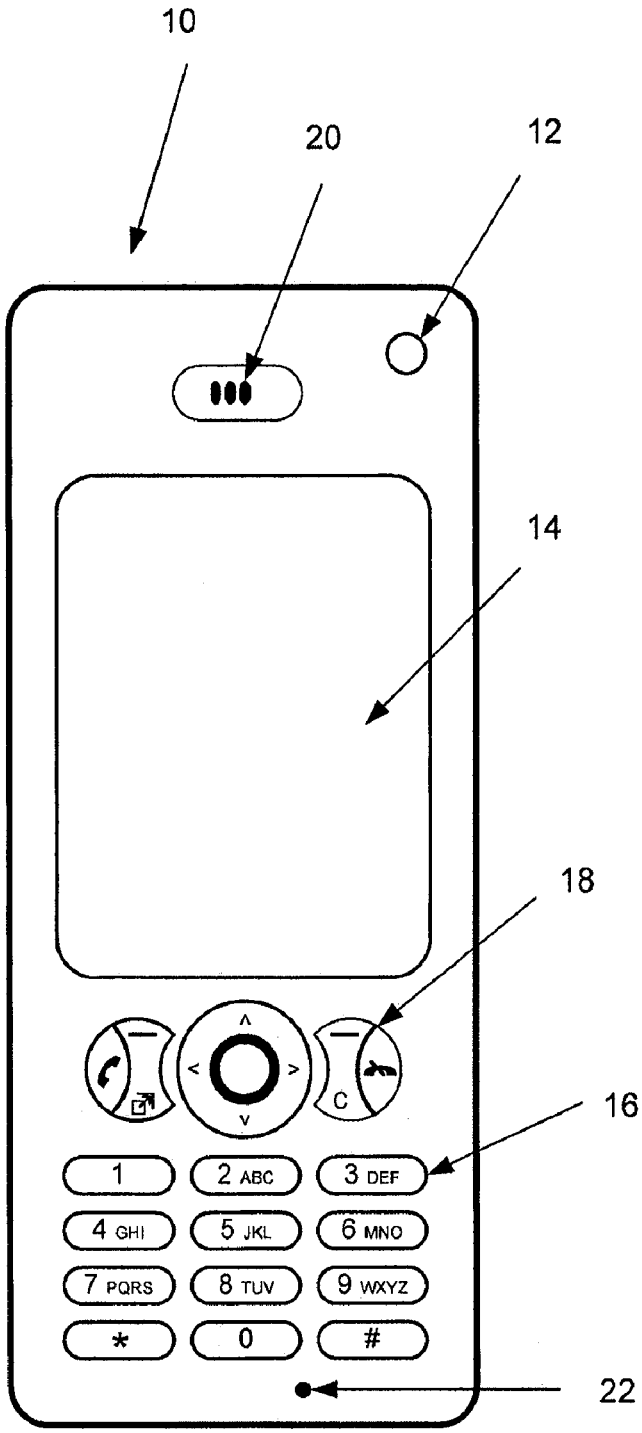
FIG. 1 is an illustration of an exemplary mobile telephone in accordance with the present invention.

Referring to FIG. 1, a mobile phone 10 is illustrated. The mobile phone 10 may include a user interface that enables the user easily and efficiently to perform one or more communication tasks (e.g., identify a contact, select a contact, make a telephone call, receive a telephone call, look up a telephone number, maintain various appointment logs, etc). The user interface of the mobile phone 10 generally includes one or more of the following components: a display 14, a keypad 16, function keys 18, a speaker 20, an antenna device 12 and a microphone 22. Normally a battery (not shown) is also included in the device.

In one embodiment, the mobile phone 10 includes a primary control circuit that is configured to carry out overall control of the functions and operations of the mobile phone 10. The control circuit may include a processing device, such as a CPU, microcontroller or microprocessor. The processing device executes code stored in a memory within the control circuit and/or in a separate memory, such as memory, in order to carry out operation of the mobile phone 10. The memory may be, for example, a buffer, a flash memory, a hard drive, a removable media, a volatile memory and/or a non-volatile memory.

The specific function and design of the mobile phone 10 as a communication device is known to persons skilled in the art, and will therefore not be described in any greater detail herein. It should also be noted that the list of features and elements included in the mobile phone 10 is in no way exhaustive. On the contrary, while the mobile phone 10 shown and described represents only one possible embodiment, it may well comprise further features and elements providing other functions The processing device and/or the control circuit are generally provided on a printed circuit board. One or more of the functional components described above may be secured directly to the printed circuit board that contains the processing device and the control circuitry and/or be located remotely on a printed circuit board by itself and/or with other functional components. As discussed below, one or more of the printed circuit boards are secured to another printed circuit board using an electrical flex connector 100, shown in FIG. 2.

Figure 2:
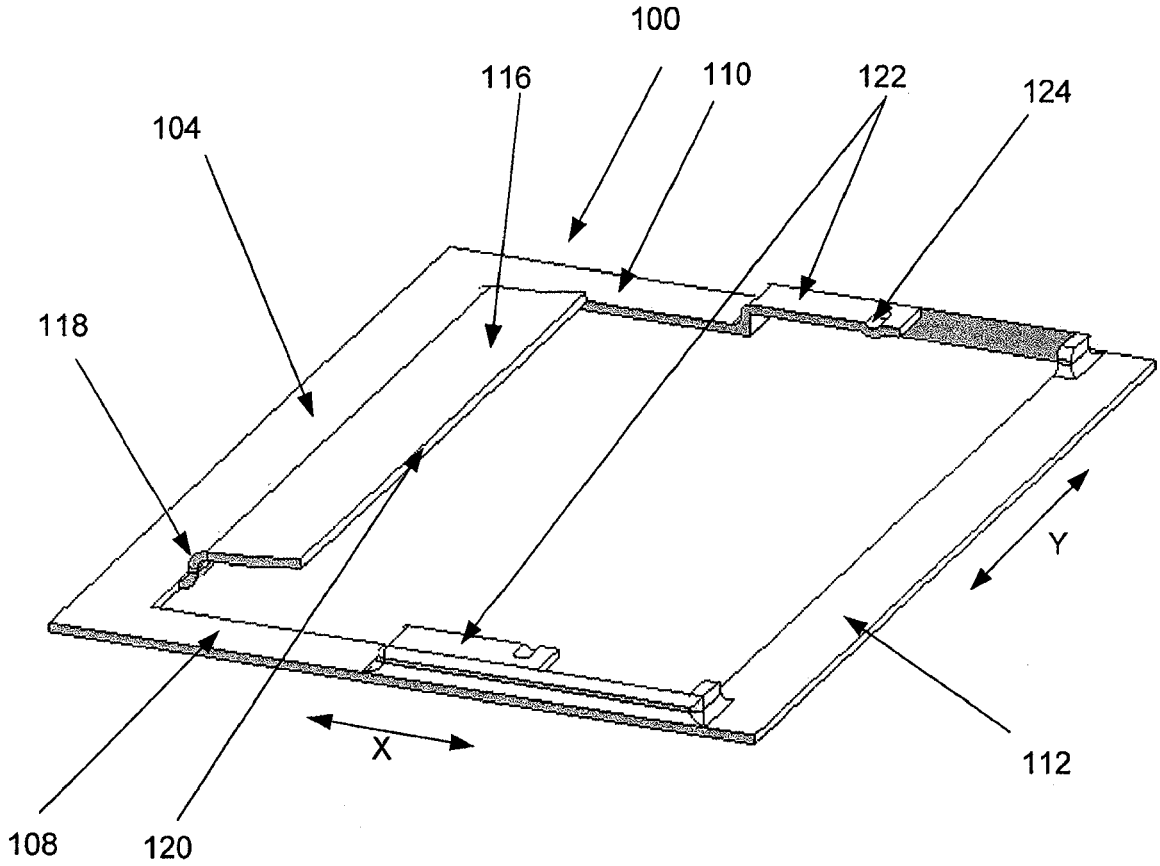
FIG. 2 is a view of a female electrical flex connector in accordance with one embodiment of the present invention.

Referring to FIG. 2, one embodiment of an electrical flex (female) connector 100 in accordance with aspects of the present invention is illustrated. The electrical flex connector 100 may be made from a conductive material or a non-conductive material depending on the design and the needs of the application.

In one embodiment, the body of the flex connector 100 is generally a unitary construction manufactured from a resilient or non resilient material. For example, the electrical flex connector 100 may be manufactured from spring steel, titanium, steel, or any other conductive and/or non-conductive material.

The electrical flex connector 100 may be manufactured in any desired manner. One manner of manufacturing the electrical flex connector 100 is by die cutting a desired material (e.g., spring steel) and applying compressive force on the material to achieve the structure discussed below. One of ordinary skill in the art will readily appreciate that there are a variety of ways to manufacture the electrical flex connector 100 in accordance with aspects of the present invention.

In one embodiment, the body of the flex connector 100 may include a fixation portion 104 for affixing the electrical flex connector 100 to an associated printed circuit board 106 (illustrated in FIGS. 3 and 5*a*-5*c*). The fixation portion 104 may have any desired configuration and may vary based on form factor, desired connection functionality and/or other criteria. As shown in FIG. 2, the body of the flex connector 100 further includes a first and second side 108, 110 formed between the fixation portion 104 and a third side 112. The fixation portion 104 is configured to receive a male flex connector (through the open end). The fixation portion 104 may be soldered or otherwise secured to a printed circuit board by an adhesive, tape or glue.

Figure 5A:
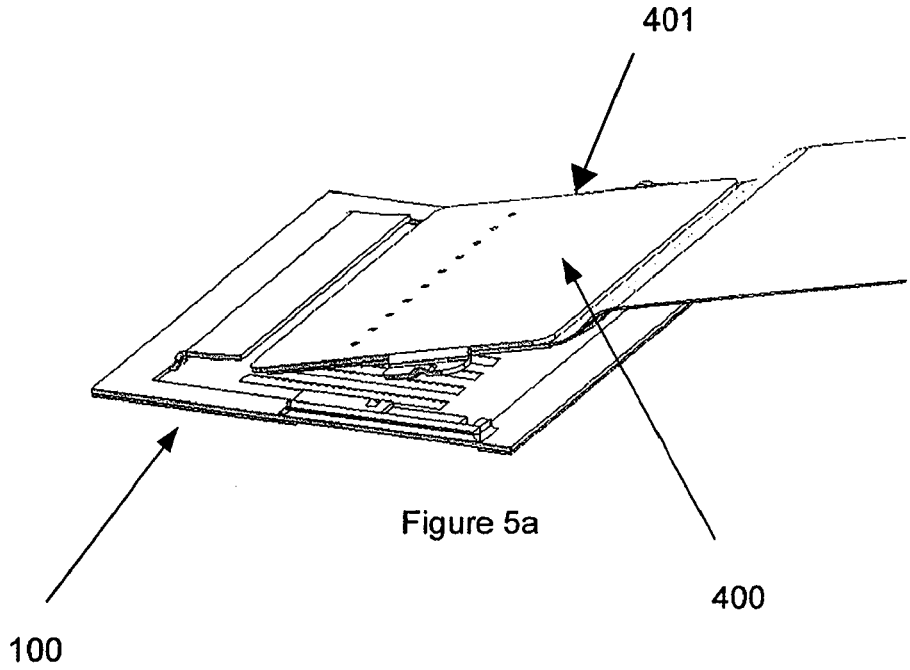
FIG. 5*a*-5*c* is an exemplary illustration of a female flex connector engaging a male flex connector in accordance with one embodiment of the present invention.
Figure 5B:
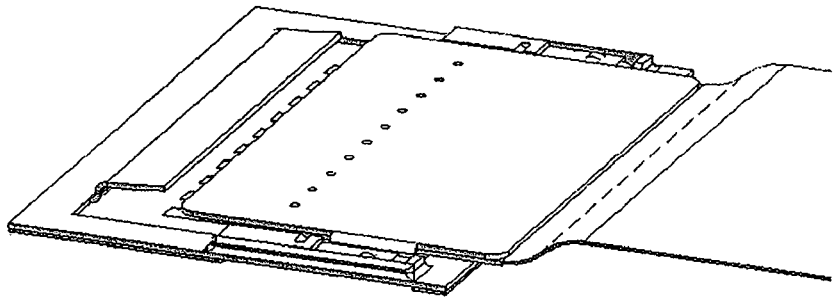
Figure 5C:
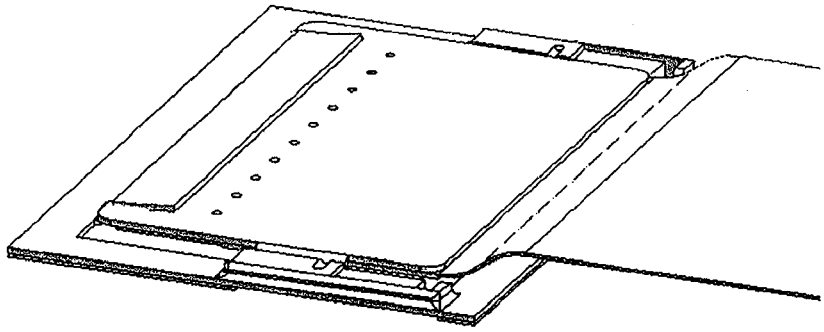

The body of the electrical flex connector 100 includes a tab member 116 which is configured to guide and to securely hold an associated flex connector between the tab member 116 and the associated printed circuit board 106, as shown in FIG. 5*c*.

The tab member 116 extends upward from the fixation portion 104 in a cantilever manner. As used herein, cantilever means a member supported at only one end.

The tab member 116 generally extends from the fixation portion 104 into a region defined by the first and second sides 108, 110 of the fixation portion 104. The tab member 116 includes a first end 118 extending in a cantilever manner from the fixation portion 104 and a second free end 120 configured to facilitate receiving an associated flex connector.

The electrical flex connector 100 may also include at least one fastening means 122. The fastening means 122 may be configured for maintaining a secure connection between the contacts of the printed circuit board and the contacts provided on the associated flex connector, as described below. The fastening means may be located on the first and second sides 108, 110 of the body of the flex connector 100 or directly on the fixation portion 104. The fastening means 122 may also facilitate alignment of the associated flex connector in a lateral direction (e.g., the y-direction as illustrated in FIG. 2). The fastening means 122 may be positioned in any desired position.

In one embodiment, fastening means 122 may be positioned at a predetermined distance from the fixation portion, wherein the predetermined distance may be based on the design of the associated flex connector or other design consideration.

In one embodiment, the fastening means 122 may include at least one fixation means 124 for securing the associated flex connector when being connected to the flex connector 100. The fixation means 124 may be of any shape, for example, a hole, a notch, a bump, a hook, a male or a female snap locking member.

Figure 6:
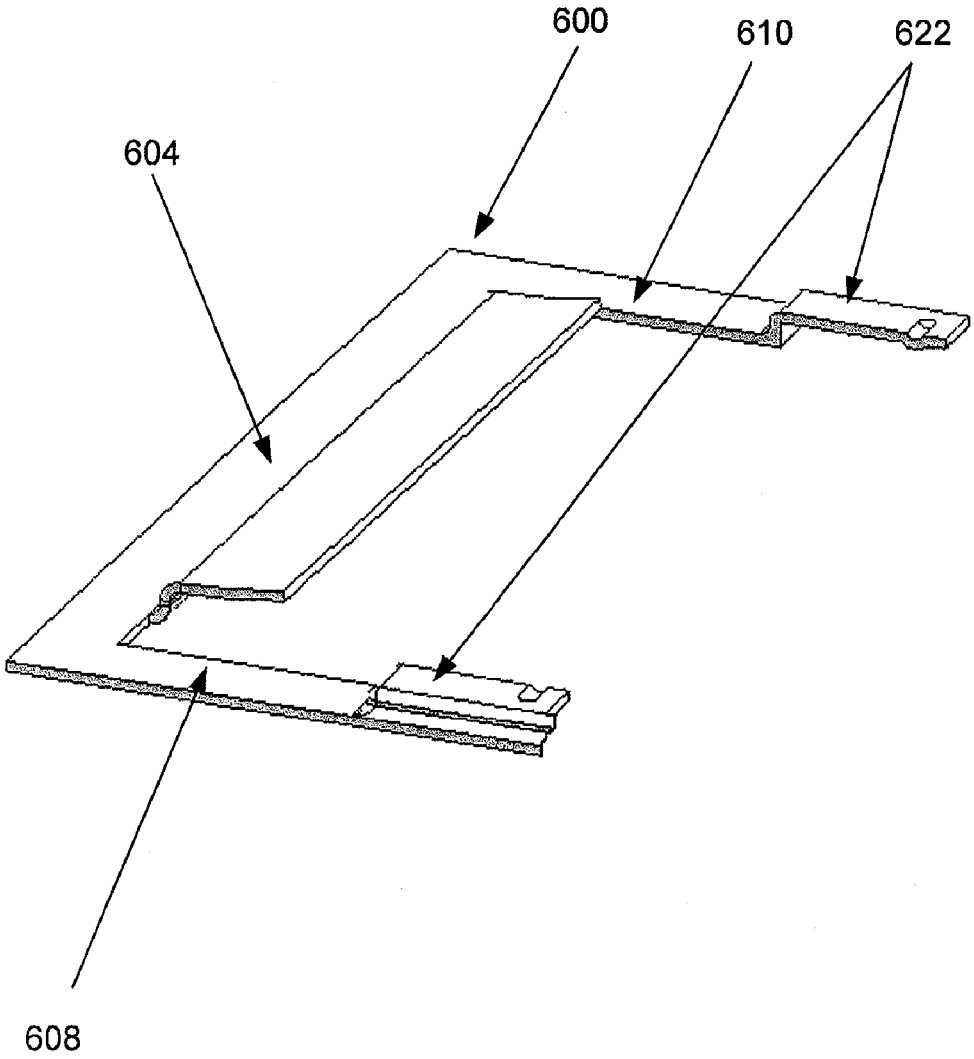
FIG. 6 is a view of a male electrical flex connector in accordance with one embodiment of the present invention.

In one embodiment, as shown in FIG. 6, the body of the flex connector 600 may include a fixation portion 604, similar to the fixation portion of FIG. 2, for affixing the electrical flex connector 600 to an associated printed circuit board 106 (illustrated in FIGS. 3 and 5*a*-5*c*) or another substrate for securing to the printed circuit board. As shown in FIG. 6, the body of the flex connector further includes a first and second side 608, 610 extending from the fixation portion 604. The flex connector 600 may also include at least one fastening means 622.

In one embodiment the body of the flex connector may include only one fixation portion without any side portion.

In one embodiment the body may include one fixation portion with side portions of any desired design.

The flex connector 100, 600 may have any desired configuration and may vary based on form factor, desired connection functionality and/or other criteria.

The flex connector 100, 600 is generally configured to engage with an associated flex connector from another printed circuit board and/or other circuitry as a female and male flex connector 100, 600, 400, respectively. The thickness of the electrical flex connector 100, 600 is preferably less than 0.7 millimeters, more preferably less than 0.5 millimeters, and even more preferable approximately 0.35 millimeter or less.

Figure 3:
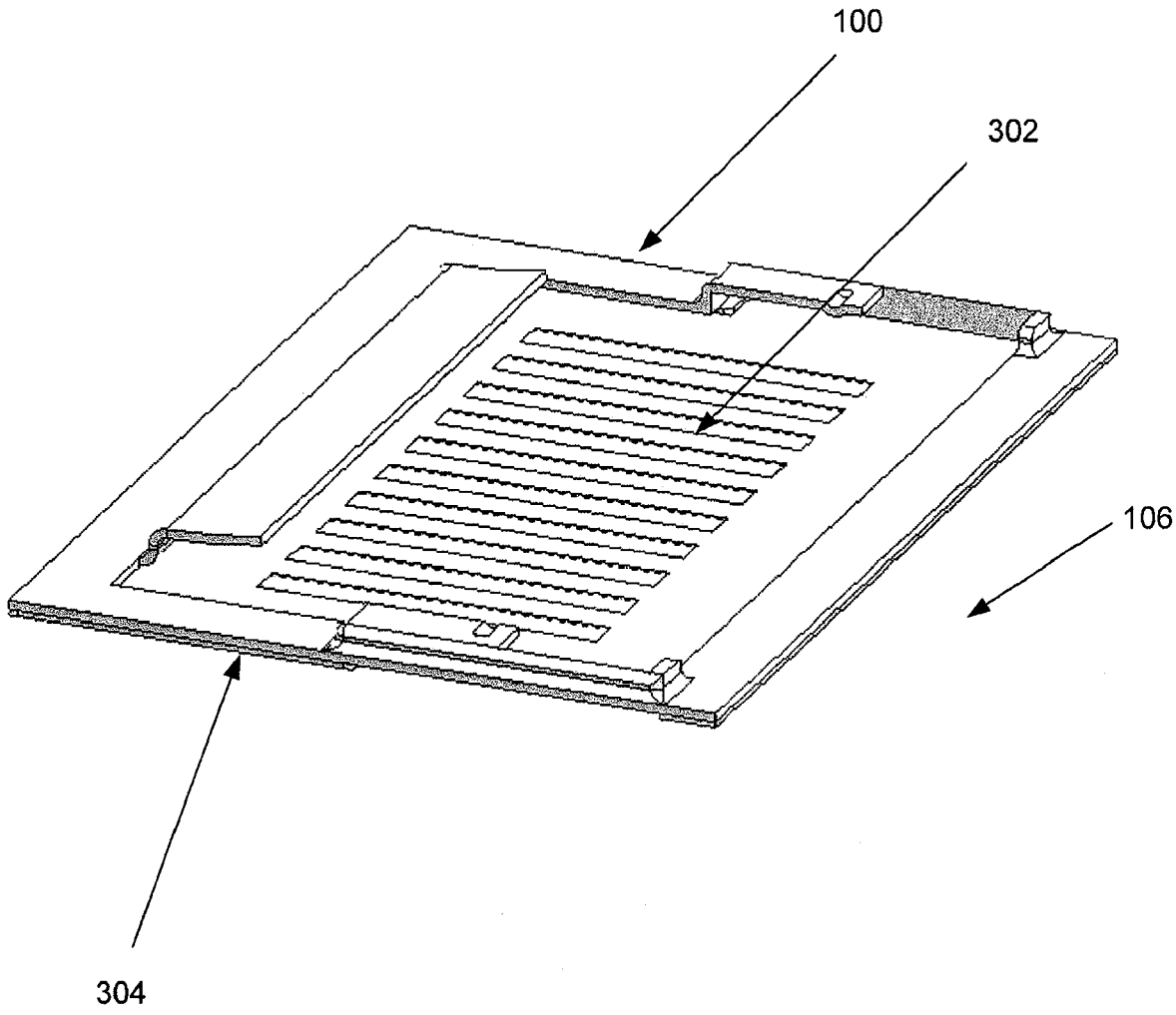
FIG. 3 is a view of said female electrical flex connector of FIG. 2 mounted on a circuit board in accordance with the present invention.

The electrical flex connector 100, 600 may be mounted onto a printed circuit board in many different ways. In one embodiment as shown in FIG. 3, one or more contact patterns 302, 304 are formed on a printed circuit board 106. The contact pattern 302, 304 may be any desired form and include multiple patterns. Generally, each contact that is electrically isolated from another contact in the contact pattern 302, 304 corresponds to an independent signal that may receive and/or transmit signals to and/or from one or more circuits populated on the printed circuit board 106 and/or otherwise coupled to one of the contacts associated with the contact pattern 302, 304.

In one embodiment, the contact pattern 302, 304 may includes two distinct patterns. The first pattern 302 corresponds to several independent signals that may be used to facilitate communication between the printed circuit board 106 and another printed circuit board and/or circuit through a cable having corresponding contacts. The second pattern 304 extends generally around the periphery of the first pattern 302. The signal along the second pattern 304 is generally substantially identical. The second pattern 304 may be used to provide a common ground signal to the flex connector 100, 600 for use by the flex connector 100, 600 and the received associated flex connector 400, as shown in FIG. 5*a*-5*c*, to provide ESD protection.

A securing agent may be applied over at least a portion of the second pattern 304. The securing agent and the second pattern 304 may correspond to the fixation portion 104 of the electrical flex connector 100. The securing agent may be any soldering agent (e.g., tin paste), adhesive (e.g. pressure sensitive adhesive, curing adhesive, etc.), tape and/or glue, alone or in combination, that is capable securely mounting the electrical flex connector 100 to the printed circuit board 106.

The female flex connector 100, 600, as described above is placed on the securing agent (e.g., fixation pattern) to secure the electrical flex connector 100, 600 to the printed circuit board 106. This may be accomplished by any means know in the art or later developed technology. For example, a pick and place machine may be used to securely place the flex connector 100, 600 in the proper position on the printed circuit board 106. As show in FIG. 3, the electrical flex connector 100, 600 is positioned over one or more contact patterns 302, 304 that form an electrical connection from the associated printed circuit board 106 to the associated flex connector. When a soldering agent is used, it may be desirable to heat (or otherwise bake) at least a portion of the printed circuit board (e.g., the securing agent) in order to wet the soldering agent for affixing the connector to the printed circuit board 106.

Figure 4:
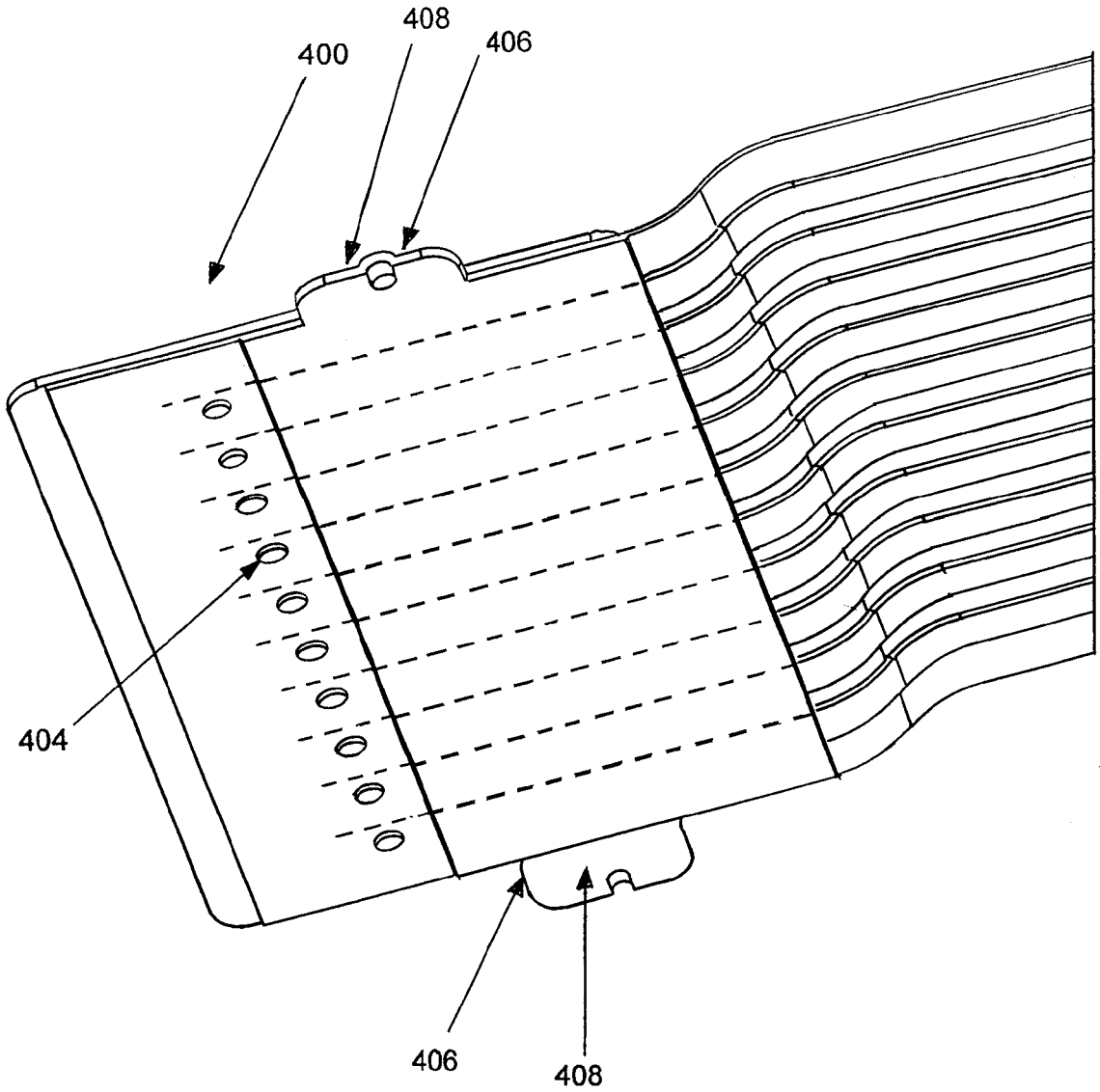
FIG. 4 is a view of a male electrical flex connector in accordance with one embodiment of the present invention.

FIG. 4 illustrates a bottom view of one embodiment of an associated male flex connector 400 according to the present invention. The male flex connector 400 may include at least one contact point 404. When the male flex connector 400 is fully engaged with the female flex connector 100, 600, as shown in FIG. 5*c*, the contact points 404 of the male flex connector are positioned over the contacts points of the first contact pattern 302 of the printed circuit board (not shown).

In one embodiment the male flex connector may be configured for having a spring characteristics for pushing the at least one contact portion onto the printed circuit board for creating contact between the contact point/s and the first contact pattern 302 on the circuit board 106.

In one embodiment the male flex connector 400 may include a stiffener 401, wherein the stiffener is configured for having a spring characteristics for pushing the male flex connector and the at least one contact point 404 onto the contact points of the first pattern 302 on the printed circuit board 106.

In one embodiment where the female flex connector 100 includes at least one fastening means 122, at least one protruding portion 406 may be arranged on the side edges of the male flex connector 400 for interacting with the fastening means 122, which allow easy insertion of the male flex connector 400 in to the female flex connector 100, 600. The protruding portions may be configured to be in any desired size and/or configuration, for example as tabs or wings.

In one embodiment, the protruding portion 406 may include at least one fixation portion 408 for interacting with the at least one fixation means 124 on the female flex connector 100, 600 for securing the male flex connector 400 when being connected to the female flex connector 100, 600. The fixation portion 408 may be of any shape, for example, a hole, a notch, a bump, a hook, a male or a female snap locking member.

In one embodiment the fixation portions 408 may be arranged directly on the male flex connector 400.

FIG. 5*a*-5*c* illustrates a male flex connector 400 being affixed to the female flex connector 100. The male flex connector 400 may be inserted and removed.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The foregoing has described the principles, preferred embodiments and modes of operation of the present invention. However, the invention should be regarded as illustrative rather than restrictive, and not as being limited to the particular embodiments discussed above. The different features of the various embodiments of the invention can be combined in other combinations than those explicitly described. It should therefore be appreciated that variations may be made in those embodiments by those skilled in the art without departing from the scope of the present invention as defined by the following claims.

The invention claimed is:

1. An electrical flex connector device for a printed circuit board, comprising:

a female member having a fixation portion for affixing said female member to an associated printed circuit board, and a tab member extending along said fixation portion and upwards in a cantilevered relation from said fixation portion, wherein said tab member comprises a first end fixed at said fixation portion and a second free end and further said tab member is configured to guide a male member of said flex connector device and to hold said male member between said tab member and said printed circuit.

2. The electrical flex connector device according to claim 1, wherein said female member further comprises at least one fastening member arranged on said female member for securely holding said male member in a predetermined position.

3. The electrical flex connector device according to claim 1, wherein said female member comprises a first and second sides extending from said fixation portion.

4. The electrical flex connector device according to claim 3, wherein said female member comprises at least one fastening member arranged on one of said first and second sides to receive a protruding portion of a male flex connector device to facilitate alignment of said male flex connector device with respect to said printed circuit board and to maintain a secure connection between contacts of said printed circuit board and contacts on said male flex connector device.

5. The electrical flex connector device according to claim 4, wherein said female member comprises a third side formed between said first and second sides.

6. The electrical flex connector device according to claim 3, wherein said tab member extends from said fixation portion into a region defined by said first and second sides.

* * * * *